US011695199B2

(12) United States Patent
Lai et al.

(10) Patent No.: US 11,695,199 B2
(45) Date of Patent: Jul. 4, 2023

(54) ANTENNA DEVICE AND MANUFACTURING METHOD THEREOF

(71) Applicant: XINTEC INC., Taoyuan (TW)

(72) Inventors: Jiun-Yen Lai, Taoyuan (TW); Ming-Chung Chung, Taoyuan (TW); Wei-Luen Suen, Taoyuan (TW)

(73) Assignee: XINTEC INC., Taoyuan (TW)

( * ) Notice: Subject to any disclaimer, the term of this patent is extended or adjusted under 35 U.S.C. 154(b) by 169 days.

(21) Appl. No.: 17/407,068

(22) Filed: Aug. 19, 2021

(65) Prior Publication Data

US 2022/0069454 A1 Mar. 3, 2022

Related U.S. Application Data

(60) Provisional application No. 63/070,056, filed on Aug. 25, 2020.

(51) Int. Cl.

| | |
|---|---|
| ***H01Q 1/38*** | (2006.01) |
| ***H01Q 1/52*** | (2006.01) |
| *H01Q 23/00* | (2006.01) |
| *H01Q 1/24* | (2006.01) |

(52) U.S. Cl.

CPC ..... *H01Q 1/38* (2013.01); *H01Q 1/526* (2013.01); *H01Q 1/243* (2013.01); *H01Q 23/00* (2013.01)

(58) Field of Classification Search

CPC ..... H01Q 1/38; H01Q 1/526; H01Q 1/243; H01Q 23/00; H01Q 1/2283; H01Q 1/36

See application file for complete search history.

(56) References Cited

U.S. PATENT DOCUMENTS

| | | | | |
|---|---|---|---|---|
| 8,134,180 | B2 | 3/2012 | Otake et al. | |
| 2011/0079903 | A1* | 4/2011 | Liu | H01L 24/03 257/E23.068 |
| 2017/0186797 | A1* | 6/2017 | Long | H01L 27/14636 |
| 2017/0301986 | A1 | 10/2017 | Nguyen et al. | |
| 2021/0398921 | A1* | 12/2021 | Chen | H01Q 1/38 |

FOREIGN PATENT DOCUMENTS

| | | | |
|---|---|---|---|
| CN | 107958896 | A | 4/2018 |
| CN | 109155303 | B | 5/2020 |
| TW | 201622503 | A | 6/2016 |

* cited by examiner

*Primary Examiner* — David E Lotter
(74) *Attorney, Agent, or Firm* — Liu & Liu

(57) ABSTRACT

An antenna device includes a first substrate, a second substrate, an antenna layer, and a redistribution layer. The first substrate has a first surface, a second surface opposite to the first surface, and an inclined sidewall adjoining the first and second surfaces. The second substrate is below the first substrate. The first surface of the first substrate faces toward the second substrate. The antenna layer is located on the first surface of the first substrate. The redistribution layer extends from the second surface of the first substrate to the second substrate along the inclined sidewall of the first substrate, and the redistribution layer has a first section in contact with an end of the antenna layer.

18 Claims, 11 Drawing Sheets

100

ANTENNA DEVICE AND MANUFACTURING METHOD THEREOF

RELATED APPLICATIONS

This application claims priority to U.S. provisional application Ser. No. 63/070,056, filed on Aug. 25, 2020, which is herein incorporated by reference.

BACKGROUND

Field of Invention

The present disclosure relates to an antenna device and a manufacturing method of the antenna device.

Description of Related Art

In a wireless communication device, an antenna serves as component that transmits and receives radio signals about radio waves, and is one of the important components in the wireless communication device. In the development of wireless communication technology, wireless communication devices are designed towards the trend of light weight and small size. However, generally speaking, the antenna still needs to be electrically connected to a chip on an external printed circuit board (PCB). Therefore, a certain setting space must be reserved in the electronic device (such as a mobile phone), which is an inconvenient factor for miniaturization. Moreover, for millimeter wave (mm-wave) antennas, the permittivity (Dk) and the loss tangent (Df) of a printed circuit board material are not low enough, which is an inconvenient factor for antenna performance.

SUMMARY

An aspect of the present disclosure is to provide an antenna device.

According to an embodiment of the present disclosure, an antenna device includes a first substrate, a second substrate, an antenna layer, and a redistribution layer. The first substrate has a first surface, a second surface opposite to the first surface, and an inclined sidewall adjoining the first and second surfaces. The second substrate is below the first substrate. The first surface of the first substrate faces toward the second substrate. The antenna layer is located on the first surface of the first substrate. The redistribution layer extends from the second surface of the first substrate to the second substrate along the inclined sidewall of the first substrate, and the redistribution layer has a first section in contact with an end of the antenna layer.

In some embodiments of the present disclosure, the first substrate is made of a material including fused silica or quartz.

In some embodiments of the present disclosure, the second substrate is made of a material including glass, fused silica or quartz.

In some embodiments of the present disclosure, each of the first and second substrates is formed as a single piece, and has no conductor therein.

In some embodiments of the present disclosure, the redistribution layer further includes a second section spaced apart from the first section and overlapping the antenna layer, and the second section of the redistribution layer is a shielding layer for the antenna layer.

In some embodiments of the present disclosure, the antenna device further includes a metal layer located on a surface of the second substrate facing away from the first substrate. The metal layer overlaps the antenna layer, and is a shielding layer for the antenna layer.

In some embodiments of the present disclosure, the antenna device further includes a bonding layer located between the first and second substrates, and covering the antenna layer.

In some embodiments of the present disclosure, the antenna device further includes a passivation layer covering the redistribution layer, the second surface of the first substrate, and a protruding portion of the second substrate free from coverage by the first substrate. The passivation layer surrounds the first substrate.

In some embodiments of the present disclosure, the passivation layer has an opening, and a portion of the redistribution layer is located in the opening.

In some embodiments of the present disclosure, the antenna device further includes a passivation layer covering a surface of the second substrate facing away from the first substrate.

Another aspect of the present disclosure is to provide a manufacturing method of an antenna device.

According to an embodiment of the present disclosure, a manufacturing method of an antenna device includes forming an antenna layer on a first surface of a first substrate, wherein the first substrate has a first surface and a second surface opposite to the first surface; bonding a second substrate to the first substrate, wherein the first surface of the first substrate faces toward the second substrate; removing an edge portion of the first substrate to form a groove such that an end of the antenna layer is exposed, wherein the first substrate forms an inclined sidewall adjoining the first and second surfaces; and forming a redistribution layer extending from the second surface of the first substrate to the second substrate along the inclined sidewall, wherein the redistribution layer has a first section in contact with the end of the antenna layer.

In some embodiments of the present disclosure, the antenna layer is directly formed on the first surface of the first substrate by sputtering.

In some embodiments of the present disclosure, forming the antenna layer includes forming a metal capping layer covering the first surface of the first substrate; and patterning the metal capping layer to form the antenna layer such that a portion of the first surface of the first substrate is exposed.

In some embodiments of the present disclosure, the manufacturing method of the antenna device further includes forming a metal layer on a surface of the second substrate facing away from the first substrate.

In some embodiments of the present disclosure, forming the redistribution layer further includes forming a second section of the redistribution layer, wherein the second section is spaced apart from the first section.

In some embodiments of the present disclosure, the manufacturing method of the antenna device further includes forming a passivation layer covering the redistribution layer, the second surface of the first substrate, and a protruding portion of the second substrate free from coverage by the first substrate, wherein the passivation layer surrounds the first substrate.

In some embodiments of the present disclosure, the manufacturing method of the antenna device further includes patterning the passivation layer to form an opening that exposes the redistribution layer; and disposing a conductive element on the redistribution layer in the opening.

In some embodiments of the present disclosure, the manufacturing method of the antenna device further includes forming a metal finish layer on the redistribution layer in the opening, wherein the metal finish layer is between the metal finish layer and the conductive element.

In the aforementioned embodiments of the present disclosure, because the antenna device includes the stacked first and second substrates and the antenna layer is formed on the first substrate, the redistribution layer can be subsequently formed to extend from the second surface of the first substrate to the second substrate along the inclined sidewall. As a result, the redistribution layer on the inclined sidewall can be in contact with an end of the antenna layer to realize an electrical connection between the second surface of the first substrate and the antenna layer. Through the aforementioned configuration, the antenna device is not limited to dispose on a printed circuit board (PCB), and materials of the first and second substrates can be selected more flexible. For example, materials with low permittivity (Dk) and low loss tangent (Df) may be selected to made the first and second substrates, which facilitating the performance of a millimeter wave (mm-wave) antenna device. Moreover, the antenna layer is connected to the redistribution layer that is on the inclined sidewall of the first substrate, thereby realizing miniaturization and reducing manufacturing costs.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the embodiments, with reference made to the accompanying drawings as follows.

DETAILED DESCRIPTION

Figure 1:
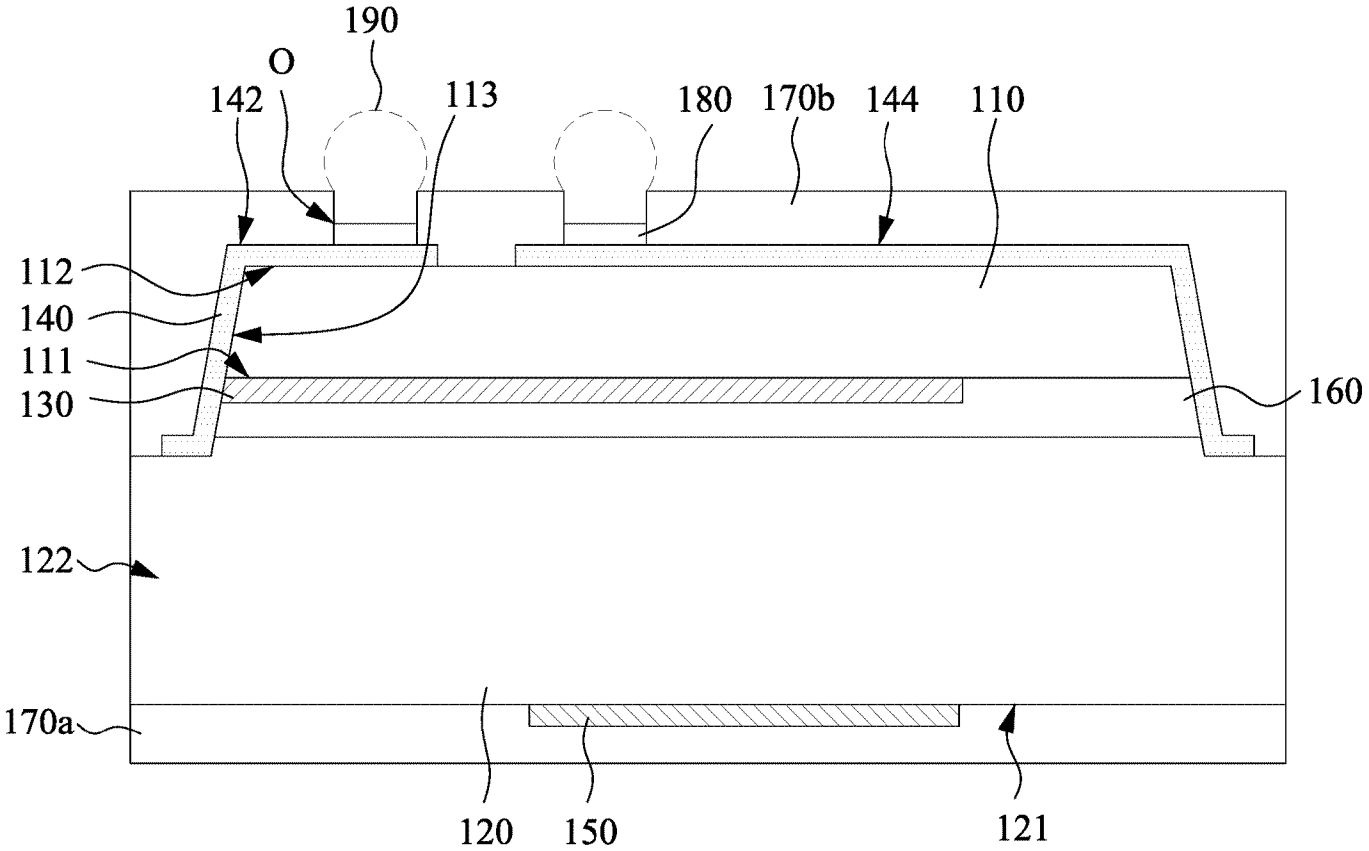
FIG. 1 is a cross-sectional view of an antenna device according to one embodiment of the present disclosure.

Reference will now be made in detail to the present embodiments of the invention, examples of which are illustrated in the accompanying drawings. Wherever possible, the same reference numbers are used in the drawings and the description to refer to the same or like parts.

FIG. 1 is a cross-sectional view of an antenna device 100 according to one embodiment of the present disclosure. As shown in FIG. 1, the antenna device 100 includes a first substrate 110, a second substrate 120, an antenna layer 130, and a redistribution layer 140. The first substrate 110 has a first surface 111, a second surface 112 opposite to the first surface 111, and an inclined sidewall 113 adjoining the first and second surfaces 111 and 112. In this embodiment, an acute angle is formed between the inclined sidewall 113 and the first surface 111, and an obtuse angle is formed between the inclined sidewall 113 and the second surface 112. The second substrate 120 is below the first substrate 110, and the first surface 111 of the first substrate 110 faces toward the second substrate 120. The antenna layer 130 is located on the first surface 111 of the first substrate 110. The redistribution layer 140 extends from the second surface 112 of the first substrate 110 to the second substrate 120 along the inclined sidewall 113 of the first substrate 110, and the redistribution layer 140 has a first section 142 in contact with an end of the antenna layer 130.

The antenna device 100 may be used in high-frequency signal transmission for 5G communication, such as Sub-6G and mm-wave antenna technical field. The redistribution layer 140 may be made of a material including copper, silver, or aluminum, the antenna layer 130 may be made of a material including copper or silver, and they may be formed by physical vapor deposition (e.g., sputtering). Therefore, the entire top surface of the antenna layer 130 can be in direct contact with the first surface 111 of the first substrate 110.

Because the antenna device 100 includes the stacked first and second substrates 110 and 120 and the antenna layer 130 is formed on the first substrate 110, the redistribution layer 140 can be subsequently formed to extend from the second surface 112 of the first substrate 110 to the second substrate 120 along the inclined sidewall 113. As a result, the redistribution layer 140 on the inclined sidewall 113 can be in contact with an end of the antenna layer 130 to realize an electrical connection between the second surface 112 of the first substrate 110 and the antenna layer 130. Through the aforementioned configuration, the antenna device 100 is not limited to dispose on a printed circuit board (PCB), and materials of the first and second substrates 110 and 120 can be selected more flexible. For example, materials with low permittivity (Dk) and low loss tangent (Df) may be selected to made the first and second substrates 110 and 120, which facilitating the performance of a millimeter wave (mm-wave) antenna device. Moreover, the antenna layer 130 is connected to the redistribution layer 140 that is on the inclined sidewall 113 of the first substrate 110, thereby realizing miniaturization and reducing manufacturing costs.

In this embodiment, the first substrate 110 is made of a material including fused silica or quartz. The second substrate 120 is made of a material including glass, fused silica or quartz. Each of the first and second substrates 110 and 120 is formed as a single piece, and has no conductor therein. For the antenna device 100 utilized in mm-wave, disposing the antenna layer 130 on a substrate including the aforementioned materials can efficiently reduce permittivity (Dk) and loss tangent (Df), which facilitating the performance of an antenna.

In addition, in this embodiment, the redistribution layer 140 further includes a second section 144 spaced apart from the first section 142, and the second section 144 at least overlaps a portion of the antenna layer 130. As a result of such a design, the second section 144 of the redistribution layer 140 may serve as a shielding layer for the antenna layer 130. The antenna device 100 may further include a metal layer 150 located on a surface 121 of the second substrate 120 facing away from the first substrate 110. The metal layer 150 may be used to other electrical connections. In some embodiments, the antenna device 100 may have no metal layer 150.

In this embodiment, the antenna device 100 further includes a bonding layer 160 and passivation layers **170*a* and 170*b*. The bonding layer 160 is located between the first and second substrates 110 and 120, and covering the antenna layer 130. The bonding layer 160 may be used to bond the second substrate 120 to the first substrate 110, and may protect the antenna layer 130. The passivation layer 170*a* covers the surface 121 of the second substrate 120 facing away from the first substrate 110, and covers and surrounds the metal layer 150. The passivation layer 170*b* covers the redistribution layer 140, the second surface 112 of the first substrate 110, and a protruding portion 122 of the second substrate 120 free from coverage by the first substrate 110. Furthermore, the passivation layer 170*b* surrounds the first substrate 110. The passivation layer 170***b* has an opening O, and a portion of the redistribution layer 140 is located in the opening O.

Moreover, the antenna device 100 may further include a metal finish layer 180 and a conductive element 190. The metal finish layer 180 is located on the redistribution layer 140 in the opening O of the passivation layer 170*b*. The conductive element 190 may be disposed on the metal finish layer 180, and thus the conductive element 190 can be electrically connected to the antenna layer 130 by the first section 142 of the redistribution layer 140. In this embodiment, the conductive element 190 may be a solder ball, but the present disclosure is not limited in this regard. In some embodiments, the antenna device 100 may have no metal finish layer 180.

It is to be noted that the connection relationships, materials, and advantages of the aforementioned elements will not be described again in the following description. In the following description, a manufacturing method of the antenna device 100 of FIG. 1 will be explained.

Figure 2:
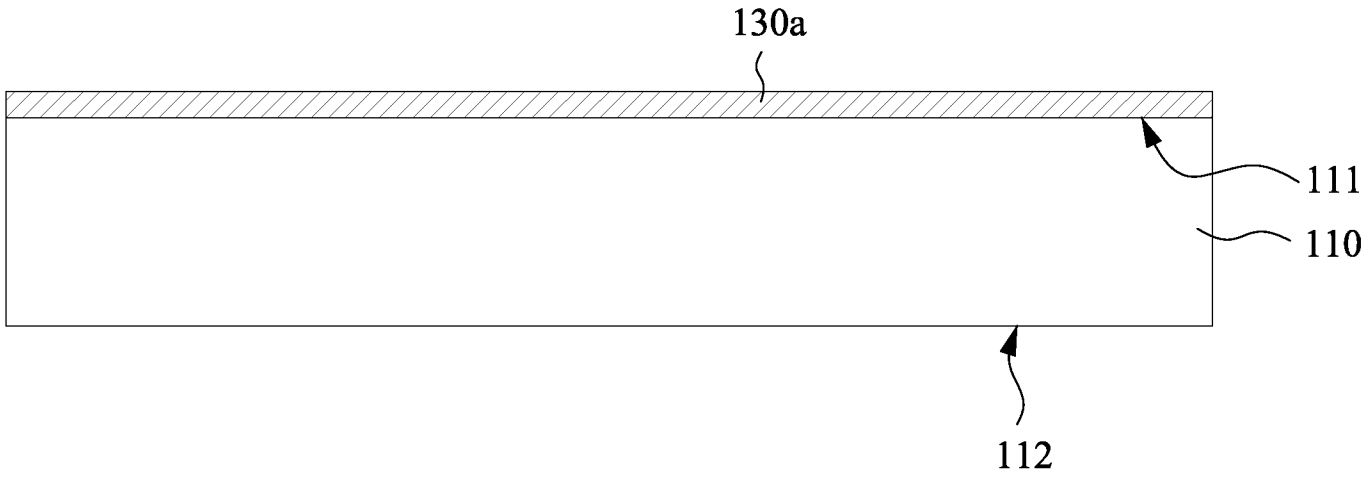
FIGS. 2 to 10 are cross-sectional views at various stages of a manufacturing method of the antenna device of FIG. 1.
Figure 3:
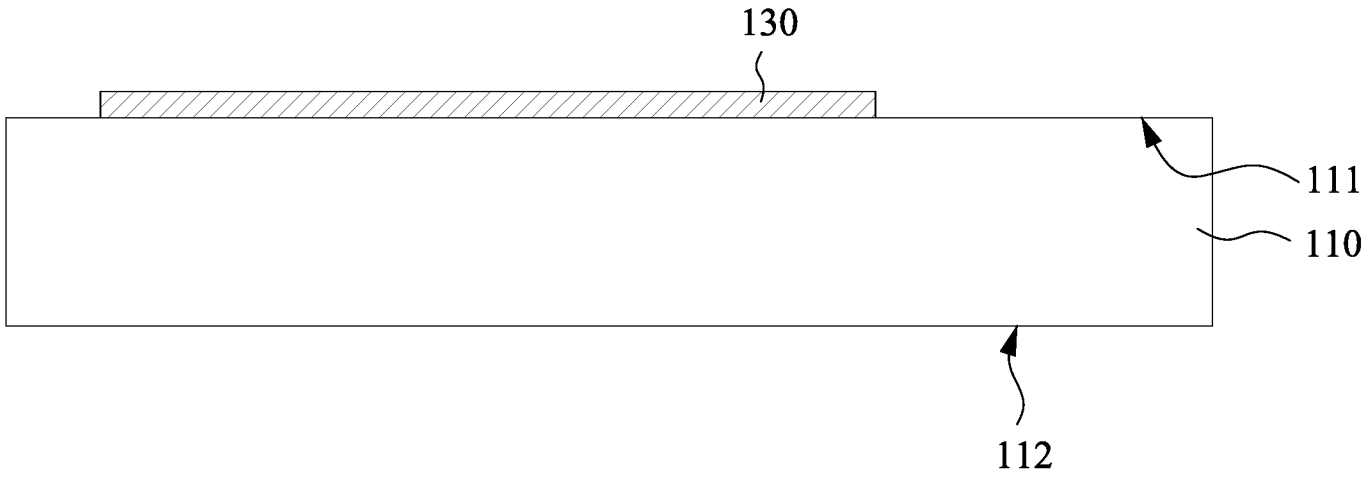

FIGS. 2 to 10 are cross-sectional views at various stages of a manufacturing method of the antenna device 100 of FIG. 1. As shown in FIG. 2 and FIG. 3, the antenna layer 130 is formed on the first surface 111 of the first substrate 110. The first substrate 110 has the first surface 111 and the second surface 112 opposite to the first surface 111. The formation of the antenna layer 130 includes forming a metal capping layer 130*a* (e.g., a copper layer) to cover the first surface 111 of the first substrate 110, and then patterning the metal capping layer 130*a* to expose a portion of the first surface 111 of the first substrate 110. As a result, the antenna layer 130 of FIG. 3 may be formed. In this embodiment, the antenna layer 130 is directly formed on the first surface 111 of the first substrate 110 by sputtering.

Figure 4:
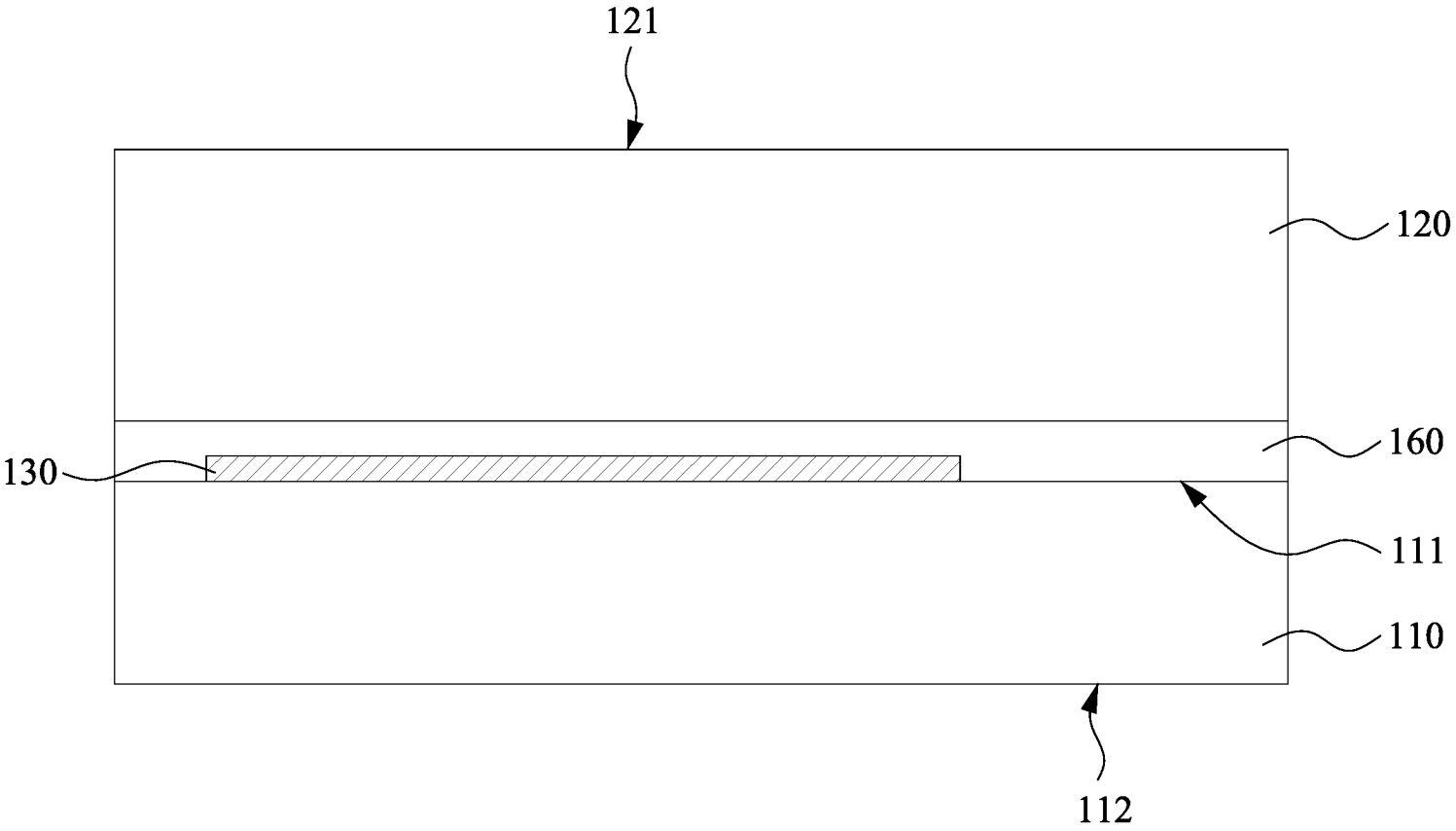

As shown in FIG. 4, after the antenna layer 130 is formed, the second substrate 120 may be bonded to the first substrate 110 by using the bonding layer 160, wherein the first surface 111 of the first substrate 110 faces toward the second substrate 120.

Figure 5:
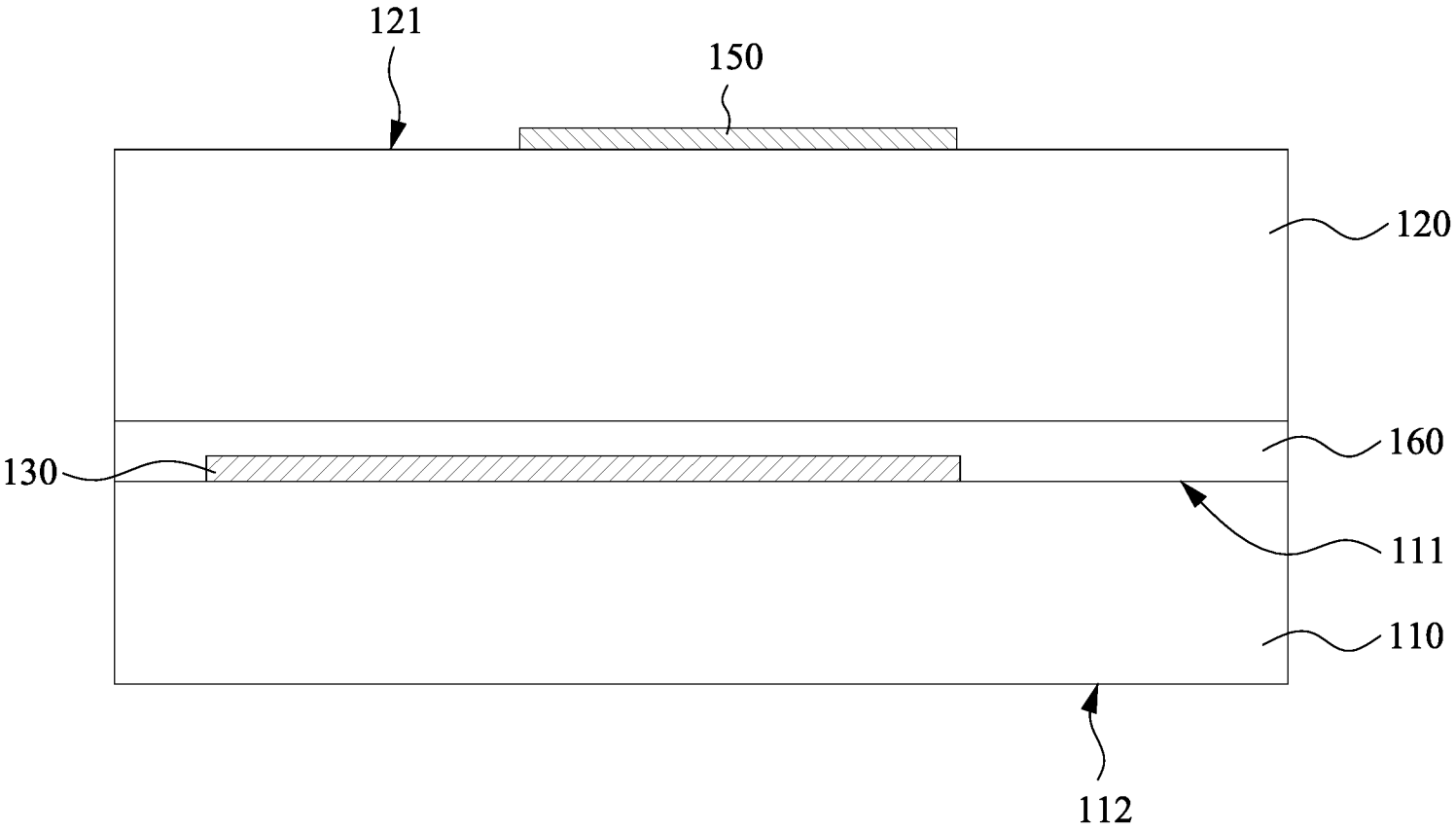
Figure 6:
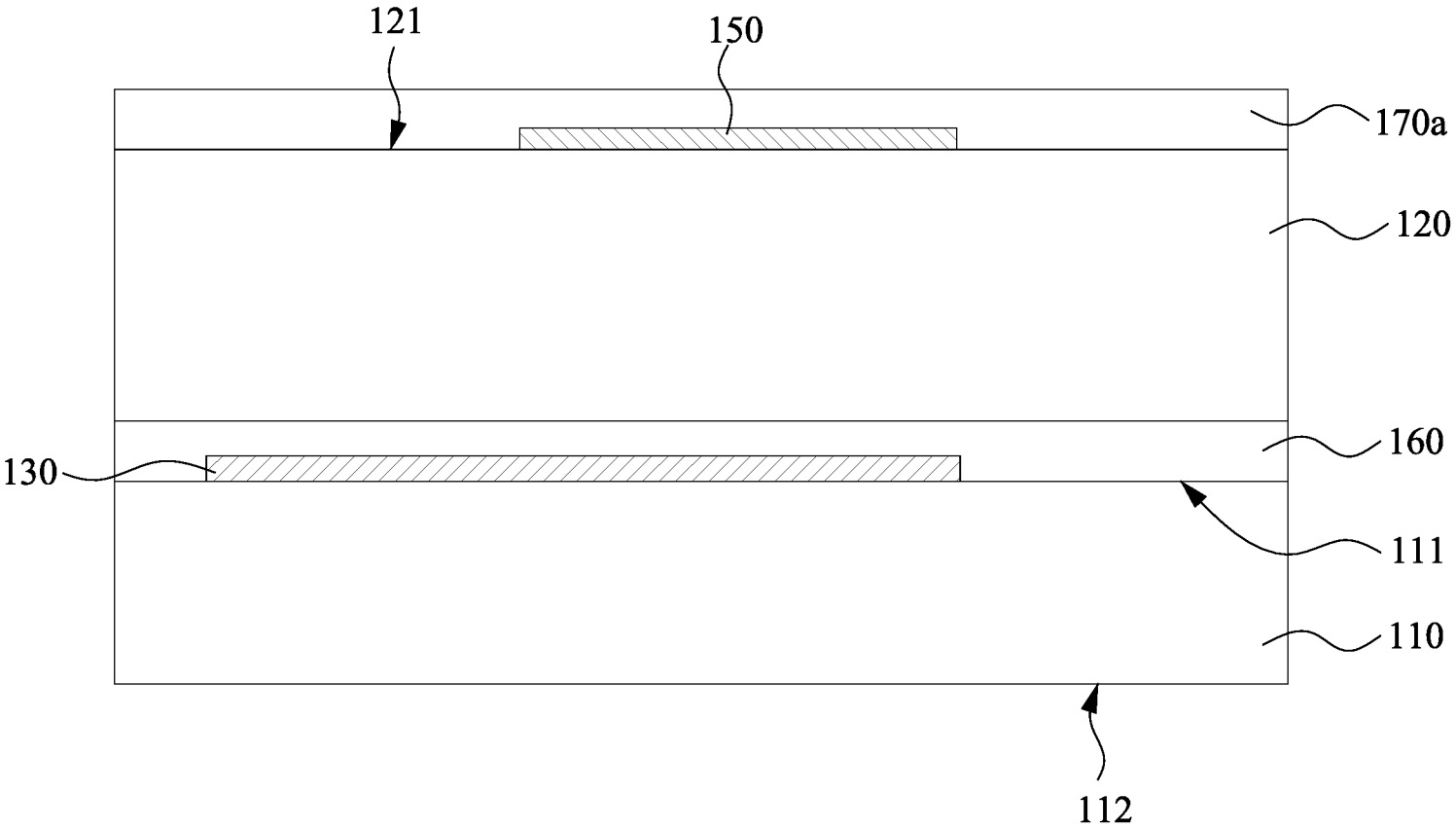
Figure 7:
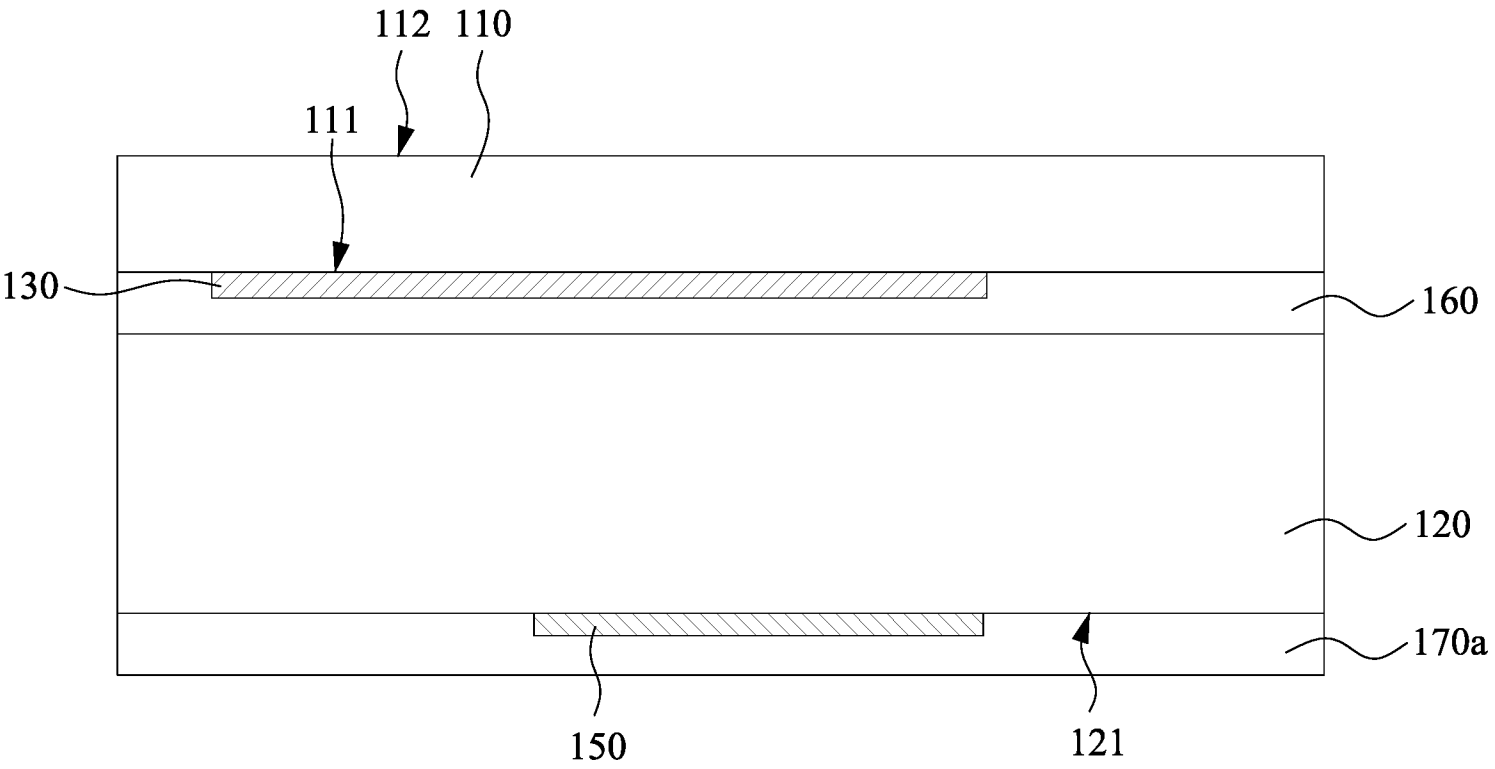

As shown in FIG. 5 and FIG. 6, thereafter, the metal layer 150 may be formed on the surface 121 of the second substrate 120 facing away from the first substrate 110. The metal layer 150 may be formed by sputtering and patterning. After the metal layer 150 is formed, the passivation layer 170*a* may be formed on the metal layer 150 and the surface 121 of the second substrate 120. Afterwards, the structure of FIG. 6 may be flipped 180 degrees to grind the second surface 112 of the first substrate 110, such that the first substrate 110 is thinned, as shown in FIG. 7.

Figure 8:
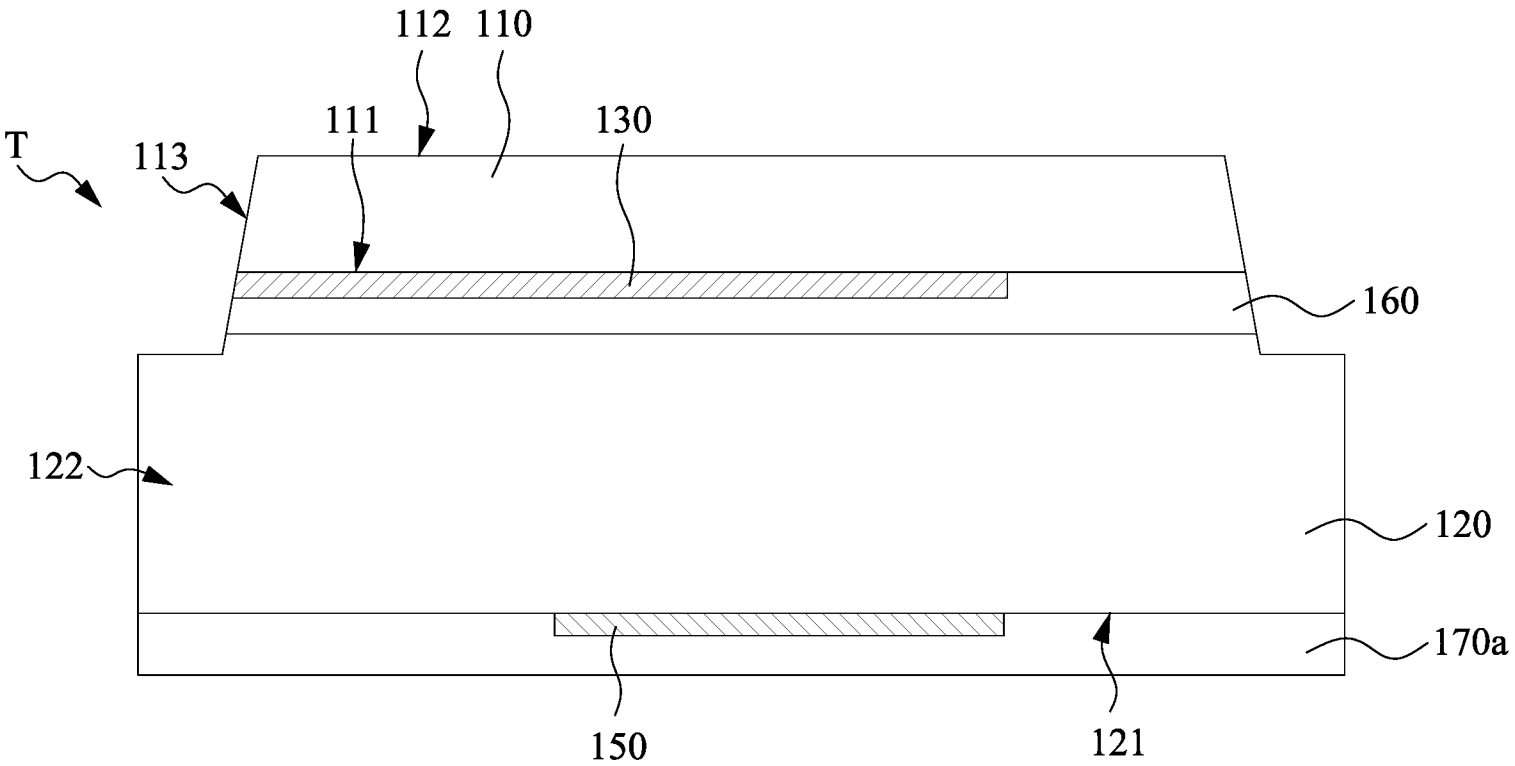

As shown in FIG. 8, after grinding the first substrate 110, an edge portion of the first substrate 110 may be removed to form a groove T, such that an end of the antenna layer 130 is exposed, wherein the first substrate 110 forms the inclined sidewall 113 adjoining the first and second surfaces 111 and 112. The removal of the edge portion of the first substrate 110 may be performed by cutting tool, but the present disclosure is not limited in this regard.

Figure 9:
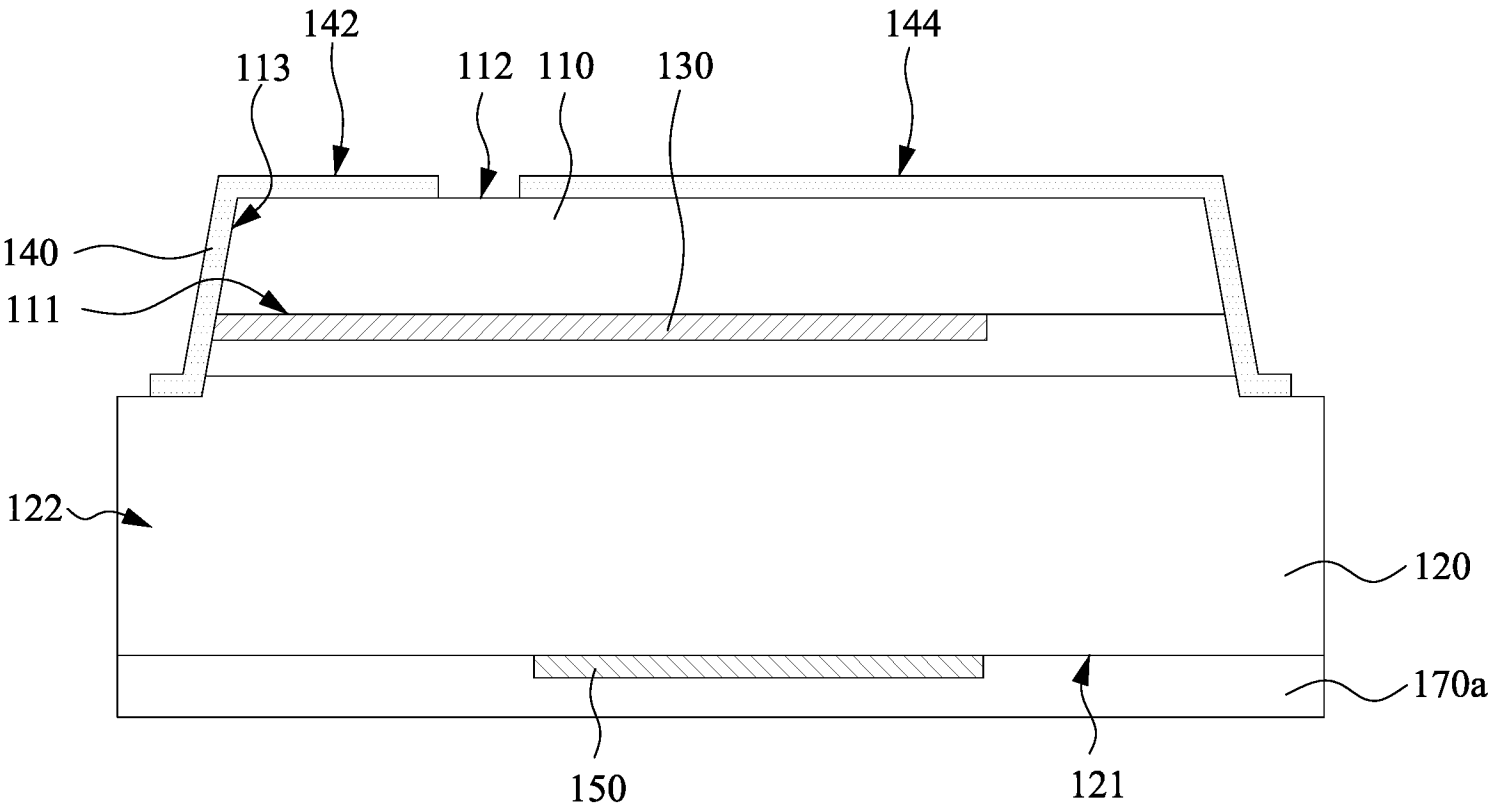

As shown in FIG. 9, thereafter, the redistribution layer 140 extending from the second surface 112 of the first substrate 110 to the second substrate 120 along the inclined sidewall 113 can be formed, wherein the redistribution layer 140 has the first section 142 in contact with the exposed end of the antenna layer 130. The redistribution layer 140 may be formed by sputtering and patterning. When the redistribution layer 140 is patterned to form the first section 142, the second section 144 of the redistribution layer 140 may be formed concurrently. The second section 144 is spaced apart from the first section 142, and is not electrically connected to the antenna layer 130. In this embodiment, the second section 144 of the redistribution layer 140 at least overlaps a portion of the antenna layer 130, and serves as a shielding layer for the antenna layer 130.

Figure 10:
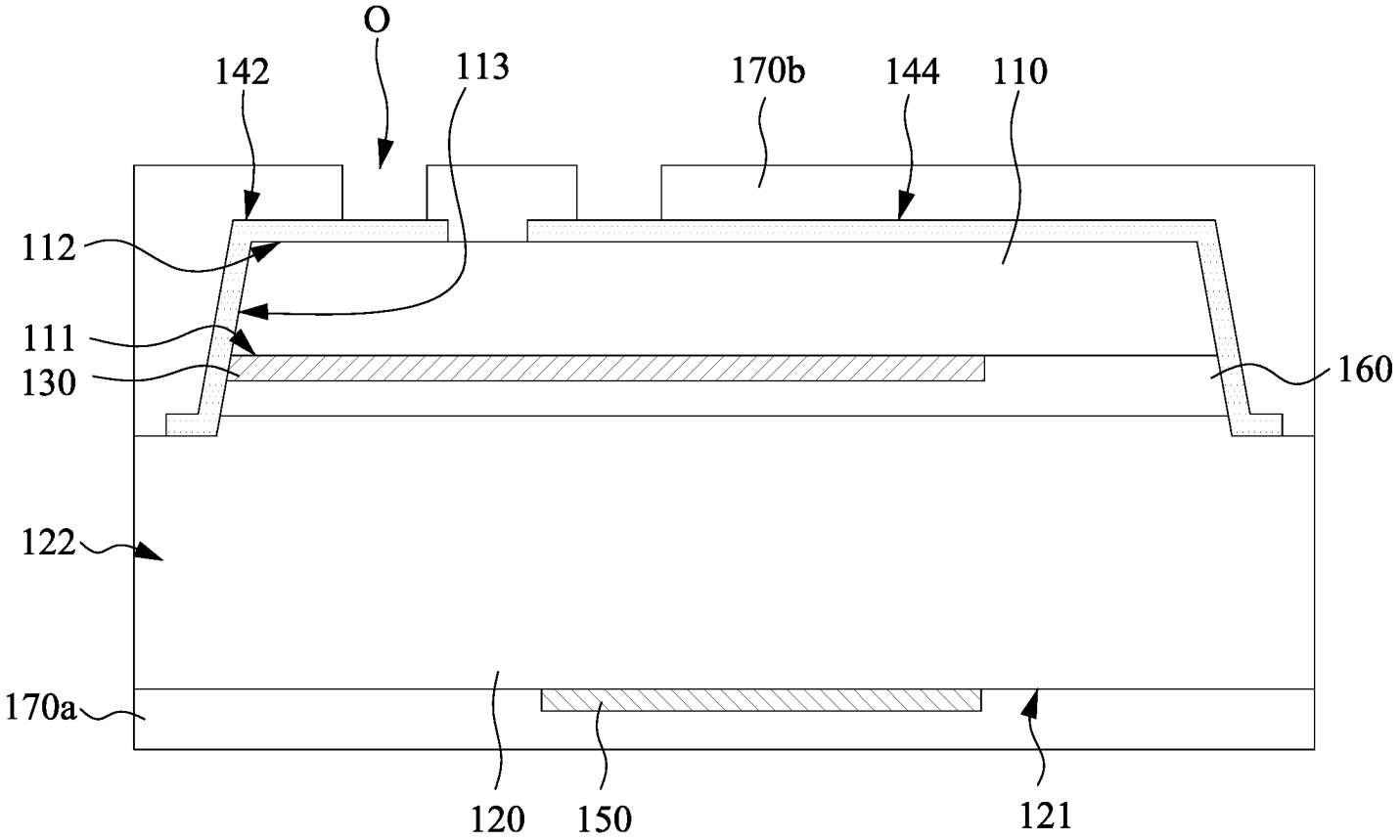

As shown in FIG. 10, after the redistribution layer 140 is formed, the passivation layer 170*b* may be formed to cover the redistribution layer 140, the second surface 112 of the first substrate 110, and the protruding portion 122 of the second substrate 120 free from coverage by the first substrate 110. The passivation layer 170*b* surrounds the first substrate 110. Afterwards, the passivation layer 170*b* may be patterned to form the opening O that exposes the redistribution layer 140. Thereafter, the conductive element 190 shown in FIG. 1 may be disposed on the redistribution layer 140 in the opening O to electrically connect an external electronic element (e.g., a power supply). In this embodiment, after the formation of the passivation layer 170*b*, the metal finish layer 180 (see FIG. 1) may further be formed on the redistribution layer 140 in the opening O, such that the metal finish layer 180 is located between the metal finish layer 140 and the conductive element 190.

Figure 11:
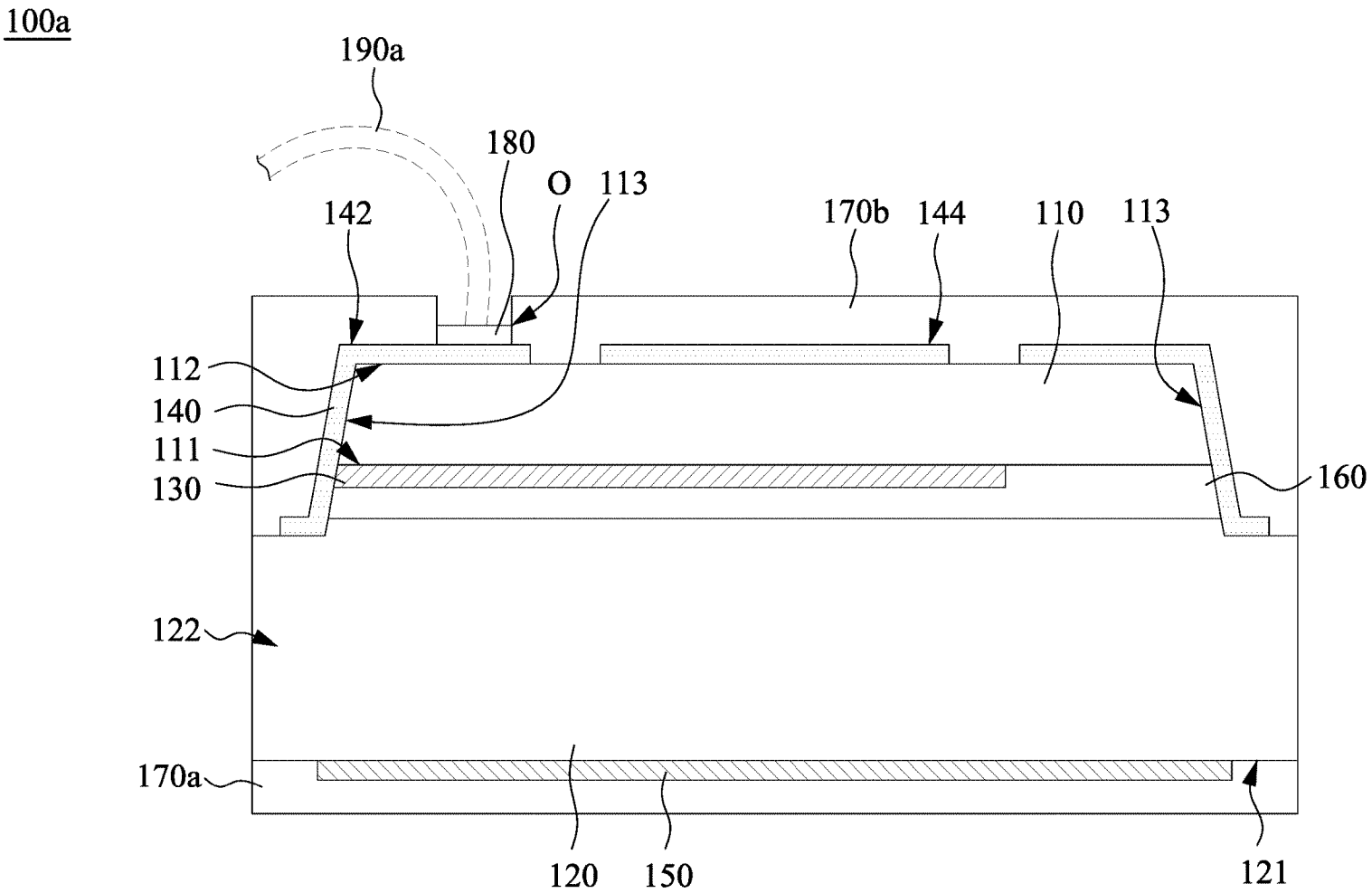
FIG. 11 is a cross-sectional view of an antenna device according to one embodiment of the present disclosure.

FIG. 11 is a cross-sectional view of an antenna device 100*a* according to one embodiment of the present disclosure. As shown in FIG. 11, the antenna device 100*a* includes the first substrate 110, the second substrate 120, the antenna layer 130, the redistribution layer 140, the passivation layer 170*b*, and a conductive element 190*a*. The difference between this embodiment and the embodiment shown in FIG. 1 is that the metal layer 150 of the antenna device 100*a* is longer than that of the antenna device 100 of FIG. 1. In this embodiment, the entire vertical projection of the antenna layer 130 on the surface 121 of the second substrate overlaps the metal layer 150, and thus the metal layer 150 serves as a shielding layer for the antenna layer 130. Furthermore, the conductive element 190*a* of the antenna device 100*a* may be a conductive wire, and an end of the conductive element 190*a* may be disposed on the metal finish layer 180 in the opening O of the passivation layer 170*b* through a wire bonding process. In some embodiments, the antenna device 100*a* may have no metal finish layer 180, and the conductive element 190*a* is directly disposed on the redistribution layer 140 in the opening O.

It will be apparent to those skilled in the art that various modifications and variations can be made to the structure of the present invention without departing from the scope or spirit of the invention. In view of the foregoing, it is intended that the present invention covers modifications and variations of this invention provided they fall within the scope of the following claims.

What is claimed is:

1. An antenna device, comprising:

a first substrate having a first surface, a second surface opposite to the first surface, and an inclined sidewall adjoining the first and second surfaces;

a second substrate below the first substrate, wherein the first surface of the first substrate faces toward the second substrate;

an antenna layer located on the first surface of the first substrate; and a redistribution layer extending from the second surface of the first substrate to the second substrate along the inclined sidewall of the first substrate, wherein the redistribution layer has a first section in contact with an end of the antenna layer.

2. The antenna device of claim 1, wherein the first substrate is made of a material comprising fused silica or quartz.

3. The antenna device of claim 1, wherein the second substrate is made of a material comprising glass, fused silica or quartz.

4. The antenna device of claim 1, wherein each of the first and second substrates is formed as a single piece, and has no conductor therein.

5. The antenna device of claim 1, wherein the redistribution layer further comprises a second section spaced apart from the first section and overlapping the antenna layer, and the second section of the redistribution layer is a shielding layer for the antenna layer.

6. The antenna device of claim 1, further comprising:

a metal layer located on a surface of the second substrate facing away from the first substrate, wherein the metal layer overlaps the antenna layer, and is a shielding layer for the antenna layer.

7. The antenna device of claim 1, further comprising:

a bonding layer located between the first and second substrates, and covering the antenna layer.

8. The antenna device of claim 1, further comprising:

a passivation layer covering the redistribution layer, the second surface of the first substrate, and a protruding portion of the second substrate free from coverage by the first substrate, and surrounding the first substrate.

9. The antenna device of claim 8, wherein the passivation layer has an opening, and a portion of the redistribution layer is located in the opening.

10. The antenna device of claim 1, further comprising:

a passivation layer covering a surface of the second substrate facing away from the first substrate.

11. A manufacturing method of an antenna device, comprising:

forming an antenna layer on a first surface of a first substrate, wherein the first substrate has a first surface and a second surface opposite to the first surface;

bonding a second substrate to the first substrate, wherein the first surface of the first substrate faces toward the second substrate;

removing an edge portion of the first substrate to form a groove such that an end of the antenna layer is exposed, wherein the first substrate forms an inclined sidewall adjoining the first and second surfaces; and forming a redistribution layer extending from the second surface of the first substrate to the second substrate along the inclined sidewall, wherein the redistribution layer has a first section in contact with the end of the antenna layer.

12. The manufacturing method of the antenna device of claim 11, wherein the antenna layer is directly formed on the first surface of the first substrate by sputtering.

13. The manufacturing method of the antenna device of claim 11, wherein forming the antenna layer comprises:

forming a metal capping layer covering the first surface of the first substrate; and patterning the metal capping layer to form the antenna layer such that a portion of the first surface of the first substrate is exposed.

14. The manufacturing method of the antenna device of claim 11, further comprising:

forming a metal layer on a surface of the second substrate facing away from the first substrate.

15. The manufacturing method of the antenna device of claim 11, wherein forming the redistribution layer further comprises:

forming a second section of the redistribution layer, wherein the second section is spaced apart from the first section.

16. The manufacturing method of the antenna device of claim 11, further comprising:

forming a passivation layer covering the redistribution layer, the second surface of the first substrate, and a protruding portion of the second substrate free from coverage by the first substrate, wherein the passivation layer surrounds the first substrate.

17. The manufacturing method of the antenna device of claim 16, further comprising:

patterning the passivation layer to form an opening that exposes the redistribution layer; and disposing a conductive element on the redistribution layer in the opening.

18. The manufacturing method of the antenna device of claim 17, further comprising:

forming a metal finish layer on the redistribution layer in the opening, wherein the metal finish layer is between the metal finish layer and the conductive element.

* * * * *